US010815095B2

(12) United States Patent
Honda

(10) Patent No.: US 10,815,095 B2
(45) Date of Patent: Oct. 27, 2020

(54) SHEET CUTTING DEVICE AND IMAGE FORMING APPARATUS INCLUDING THE SHEET CUTTING DEVICE

(71) Applicant: Ryo Honda, Kanagawa (JP)

(72) Inventor: Ryo Honda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/351,567

(22) Filed: Mar. 13, 2019

(65) Prior Publication Data

US 2019/0284007 A1 Sep. 19, 2019

(30) Foreign Application Priority Data

Mar. 16, 2018 (JP) ..... 2018-049656

(51) Int. Cl.
*B65H 35/06* (2006.01)
*B41J 11/70* (2006.01)
(Continued)

(52) U.S. Cl.
CPC ..... *B65H 35/06* (2013.01); *B26D 7/02* (2013.01); *B41J 11/70* (2013.01); *B65H 29/20* (2013.01);
(Continued)

(58) Field of Classification Search
CPC ..... B65H 35/06; B65H 29/20; B65H 2301/5151; B26D 7/02; B26D 7/015; B26D 2007/005; B41J 11/70
(Continued)

(56) References Cited

U.S. PATENT DOCUMENTS 4,488,466 A * 12/1984 Jones ..... B26D 1/085 225/105
5,787,778 A * 8/1998 Saito ..... B26D 1/205 83/383
(Continued)

FOREIGN PATENT DOCUMENTS

CN 104070841 10/2014
EP 1 193 035 A1 4/2002
(Continued)

OTHER PUBLICATIONS

Espacenet machine translation of JP20032260830A, https://www.epo.org/index.html (Year: 2003).*
(Continued)

*Primary Examiner* — Leslie A Nicholson, III
(74) *Attorney, Agent, or Firm* — Oblon, McClelland, Maier & Neustadt, L.L.P.

(57) ABSTRACT

A sheet cutting device includes a cutter, a movable member, a driving device, and a sheet holder. The movable member moves the cutter in a cutting direction. The driving device drives the movable member. The sheet holder is disposed on a downstream side of a sheet cutting position of the cutter in a sheet conveyance direction, to hold a sheet. The sheet holder includes a sheet holding member that is disposed on a sheet cutting start side of the cutter and is movable to a sheet holding position at which the sheet holding member holds the sheet and a non-holding position at which the sheet holding member does not hold the sheet. When the sheet is cut by the cutter, the sheet holding member moves to the sheet holding position. After cutting of the sheet has been completed, the sheet holding member moves to the non-holding position.

12 Claims, 3 Drawing Sheets

(51) Int. Cl.

| | |
|---|---|
| ***B65H 29/20*** | (2006.01) |
| ***B26D 7/02*** | (2006.01) |
| *B26D 7/01* | (2006.01) |
| *B26D 7/00* | (2006.01) |

(52) U.S. Cl.
CPC ..... *B26D 7/015* (2013.01); *B26D 2007/005* (2013.01)

(58) Field of Classification Search
USPC ..... 270/5.02, 21.1, 52.17
See application file for complete search history.

(56) References Cited

U.S. PATENT DOCUMENTS

| | | | | |
|---|---|---|---|---|
| 6,302,602 | B1 * | 10/2001 | Kiyohara | B26D 1/045 400/593 |
| 7,547,154 | B2 * | 6/2009 | Kawaguchi | B26D 1/085 400/621 |
| 9,238,566 | B2 * | 1/2016 | Ogawa | B65H 35/04 |
| 9,446,609 | B2 * | 9/2016 | Yamashita | B26D 1/185 |
| 2012/0222530 | A1 | 9/2012 | Yoshinuma et al. | |
| 2016/0130110 | A1 | 5/2016 | Honda et al. | |
| 2017/0217719 | A1 | 8/2017 | Honda | |
| 2017/0368849 | A1 | 12/2017 | Masunaga | |
| 2018/0257902 | A1 | 9/2018 | Honda | |

FOREIGN PATENT DOCUMENTS

| | | |
|---|---|---|
| EP | 1 749 672 A1 | 2/2007 |
| JP | 11-078140 | 3/1999 |
| JP | 2003-260830 A | 9/2003 |
| JP | 2004-268226 | 9/2004 |
| JP | 2012-183603 | 9/2012 |
| JP | 2013-010322 | 1/2013 |

OTHER PUBLICATIONS

Extended European Search Report dated May 28, 2019 in Patent Application No. 19160465.1, citing documents AO-AR therein, 7 pages.

* cited by examiner

SHEET CUTTING DEVICE AND IMAGE FORMING APPARATUS INCLUDING THE SHEET CUTTING DEVICE

CROSS-REFERENCE TO RELATED APPLICATION

This patent application is based on and claims priority pursuant to 35 U.S.C. § 119(a) to Japanese Patent Application No. 2018-049656, filed on Mar. 16, 2018, in the Japan Patent Office, the entire disclosure of which is hereby incorporated by reference herein.

BACKGROUND

Technical Field

Aspects of the present disclosure relate to a sheet cutting device to cut a sheet and an image forming apparatus including the sheet cutting device.

Related Art

There is an image forming apparatus such as a printer, a copying machine, and a facsimile using a sheet (referred to as roll sheet below) wound in a roll-like shape as a recording medium. Such an image forming apparatus includes a sheet cutting device for cutting the roll sheet at a predetermined position in a sheet conveyance direction.

For a conventional sheet cutting device, in the middle of cutting a wide sheet, the sheet may be cut obliquely due to a weight of the sheet at a portion of the sheet being cut on the downstream side of the cutting position in the conveyance direction and oblique cutting may occur.

SUMMARY

In an aspect of the present disclosure, there is provided a sheet cutting device that includes a cutter, a movable member, a driving device, and a sheet holder. The cutter cuts a sheet conveyed through a conveyance path to a desired length. The movable member moves the cutter in a cutting direction. The driving device drives the movable member. The sheet holder is disposed on a downstream side of a sheet cutting position of the cutter in a sheet conveyance direction, to hold the sheet. The sheet holder includes a sheet holding member that is disposed on a sheet cutting start side of the cutter and is movable to a sheet holding position at which the sheet holding member holds the sheet and a non-holding position at which the sheet holding member does not hold the sheet. When the sheet is cut by the cutter, the sheet holding member moves to the sheet holding position. After cutting of the sheet has been completed, the sheet holding member moves to the non-holding position.

In another aspect of the present disclosure, there is provided an image forming apparatus that includes the sheet cutting device

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
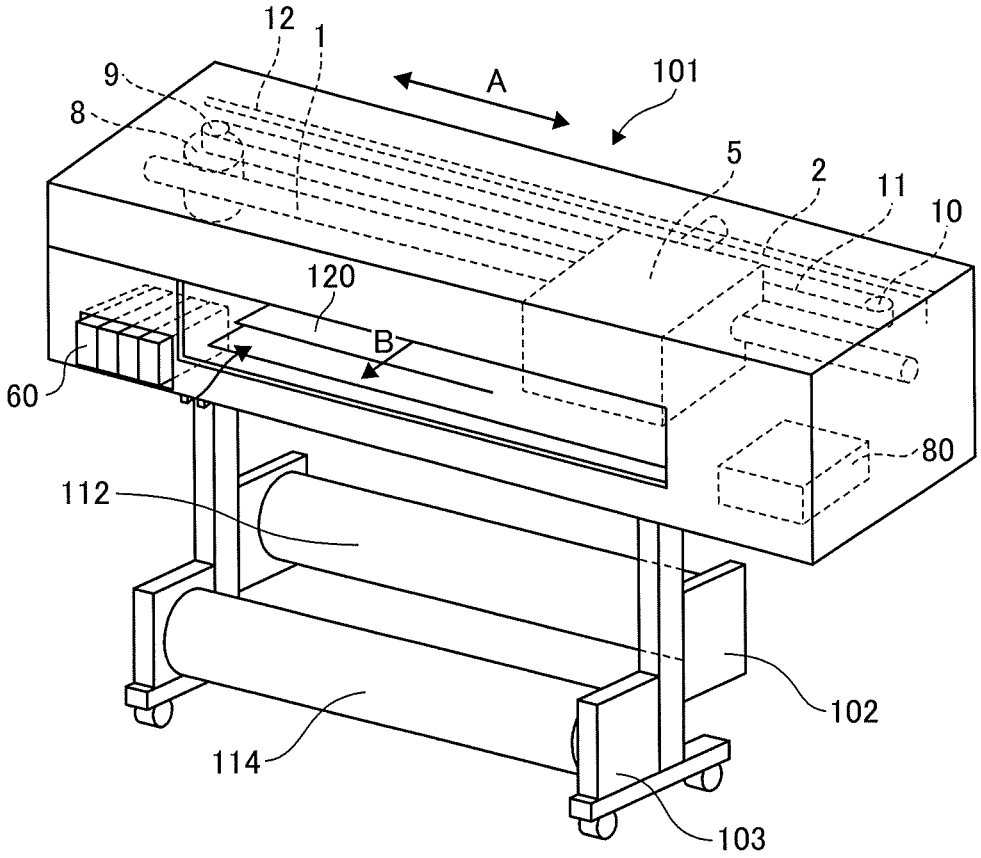
FIG. 1 is an external perspective view of an example of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

FIG. 1 is an external perspective view of an example of an image forming apparatus according to an embodiment of the present disclosure. The image forming apparatus illustrated in FIG. 1 is a serial type image forming apparatus and includes an apparatus body 101, a sheet feeding device 102 which is arranged below the apparatus body 101, and a winding device 103 which is similarly arranged below the apparatus body 101.

Figure 2:
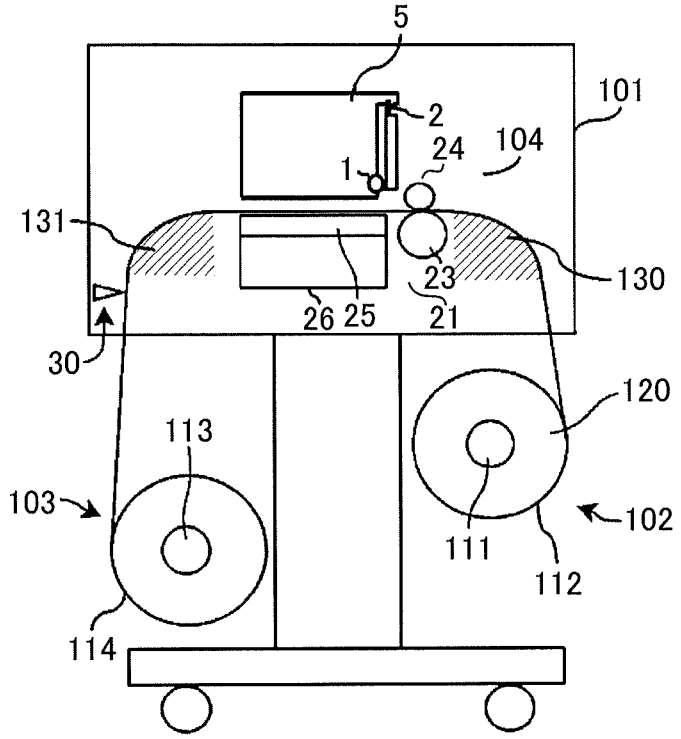
FIG. 2 is a schematic cross-sectional view of an apparatus configuration in which a sheet feeding device and a winding device are integrally formed with an apparatus body.

FIG. 2 is a cross-sectional view schematically illustrating a general configuration of the image forming apparatus having an apparatus configuration in which the sheet feeding device 102 and the winding device 103 are integrally formed with the apparatus body. The configuration in FIG. 2 is different from the configuration in FIG. 1 only in that the sheet feeding device and the winding device are arranged below the apparatus body or are integrally formed, and other configurations are the same. Therefore, the configurations in FIGS. 1 and 2 will be described here together.

In the apparatus body 101, an image forming device 104 (FIG. 2) which forms an image on a roll sheet which is a roll-shaped recording medium is arranged. In the image forming device 104, a guide rod 1 and a guide stay 2 which are guide members are stretched around both side plates, and the guide rod 1 and the guide stay 2 support a carriage 5 to be movable in a direction of an arrow A (main scanning direction, carriage moving direction).

On one side in the main scanning direction, a main scanning motor 8 which is a driving source for reciprocating the carriage 5 is arranged. A timing belt 11 is stretched around a driving pulley 9 which is rotated and driven by the main scanning motor 8 and a driven pulley 10 which is arranged on the other side in the main scanning direction. A belt holding portion of the carriage 5 is secured to the timing belt 11, and the main scanning motor 8 is driven to reciprocate the carriage 5 in the main scanning direction (A direction).

The carriage 5 includes a plurality of recording heads in which a liquid discharge head and a head tank for supplying liquid to the head are integrally formed. In the recording head, a nozzle line including a plurality of nozzles for discharging liquid droplets is arranged in a sub-scanning direction (B direction) perpendicular to the main scanning direction, and the recording head is mounted in a state the droplet is discharged downward.

An encoder sheet 12 is arranged along the moving direction of the carriage 5, and the carriage 5 includes an encoder sensor 13 which reads the encoder sheet 12. The encoder sheet 12 and the encoder sensor 13 configure a linear encoder 14, and the position and the speed of the carriage 5 are detected from an output of the linear encoder 14.

In a main scanning region of the carriage 5, in a recording region, a roll sheet 120 is fed from the sheet feeding device 102 and is intermittently conveyed to the direction perpendicular to the main scanning direction of the carriage 5 (sub-scanning direction, paper sheet conveyance direction: direction of arrow B) by a conveyer 21.

Ink of each color is supplied from an ink cartridge 60, which is a main tank replaceably attached to the apparatus body 101, to the head tank of the recording head via a supply tube. On one side of the carriage 5 in the main scanning direction, a maintenance and recovery mechanism 80 which maintains and recovers the recording head is arranged on the side of a conveying guide member 25.

The conveyer 21 includes a conveyance roller 23 for conveying the roll sheet 120 which is a roll-shaped medium fed from the sheet feeding device 102 and a pressure roller 24 arranged to face the conveyance roller 23. The conveying guide member 25 having a plurality of suction holes and a suction fan 26 as a suctioning device for performing suction from the suction holes of the conveying guide member 25 are provided on the downstream side of the conveyance roller 23.

In FIG. 1, a roll body 112 is set in the sheet feeding device 102. As illustrated in FIG. 2, the roll body 112 is formed by winding a sheet which is a long roll-shaped medium around a hollow shaft 111 such as a paper tube and the like which is a core member in a roll-like form.

In the present embodiment, either one of the roll body 112 in which an end of the roll sheet 120 is bonded and secured to the hollow shaft 111 with paste or the roll body 112 in which the end of the roll sheet 120 is not bonded and secured to the hollow shaft 111 may be attached.

As illustrated in FIG. 2, in the apparatus body 101, a guide member 130 which guides the roll sheet 120 drawn out from the roll body 112 of the sheet feeding device 102 and a sheet ejection guide 131 which guides the roll sheet 120 on the downstream side of the conveying guide member 25 are arranged.

The winding device 103 includes a hollow shaft 113 (FIG. 2) such as a paper tube which is a core member, and a front end of the roll sheet 120 on which an image has been formed is bonded to the hollow shaft 113 with tape and the like. A roll body 114 of the winding device 103 is obtained by winding the roll sheet 120 around the hollow shaft 113.

In the image forming apparatus configured as described above, at the time of forming an image, the carriage 5 is moved in the main scanning direction, and the roll sheet 120 fed from the sheet feeding device 102 is intermittently transferred by the conveyer 21. Then, by driving a recording head 6 according to image information (print information) to discharge the liquid droplets, a required image is formed on the roll sheet 120. The roll sheet 120 on which the image has been formed is conveyed through a conveyance path, is guided by the sheet ejection guide 131, and is wound around a hollow shaft 113 in the winding device 103.

On a downstream side of the sheet ejection guide 131 in the conveyance direction, a cutter device 30 (FIG. 2) as a sheet cutting device for cutting the roll sheet 120 on which the image has been formed by the recording head to a predetermined length is arranged.

In the above-described embodiment, the image forming apparatus including a roll body holding device has been described. However, embodiments of the present disclosure are not limited to the above-described embodiment. For example, an embodiment of the present disclosure may be a liquid discharge apparatus including the roll body holding device.

Figure 3:
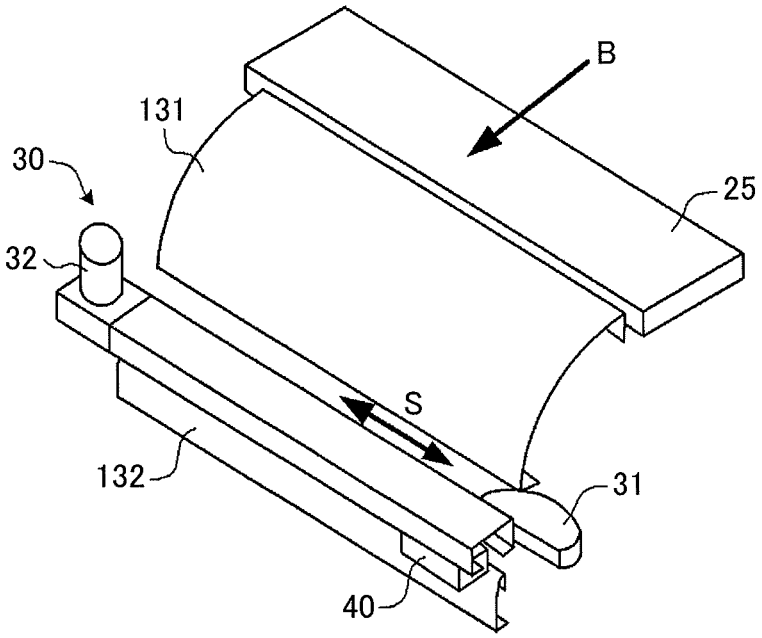
FIG. 3 is a perspective view of a configuration of a periphery of a sheet cutting unit for cutting a sheet by a cutter device.
Figure 4:
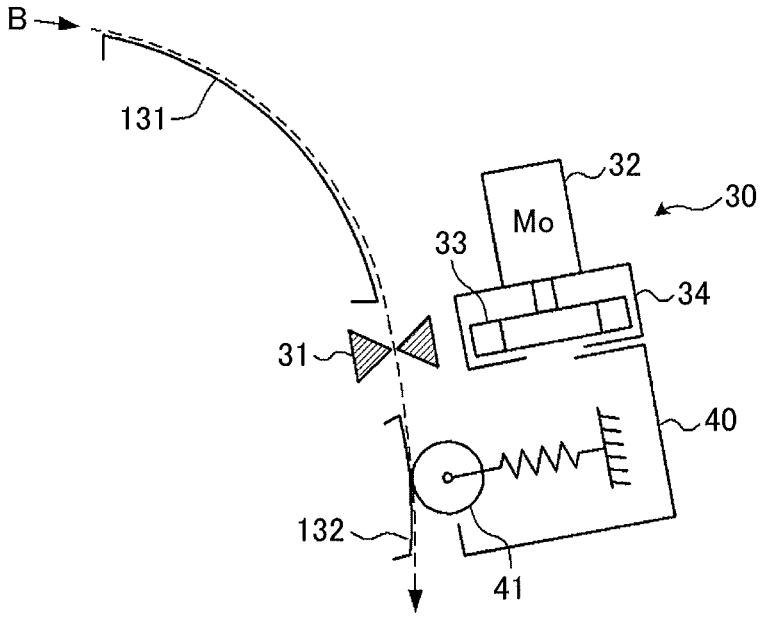
FIG. 4 is a schematic side view of a configuration of the sheet cutting unit.

FIG. 3 is a perspective view of a configuration of a periphery of a sheet cutting unit for cutting a sheet by a cutter device. FIG. 4 is a schematic side view of a configuration of the sheet cutting unit. In FIGS. 3 and 4, the sheet cutting unit includes a sheet ejection guide 131, a lower guide 132, the cutter device 30, a sheet holder 40, and the like.

The sheet ejection guide 131 is a guide member which supports and guides the sheet on which an image has been formed.

The cutter device 30 is arranged on the downstream side of the sheet ejection guide 131 in the sheet conveyance direction (direction of arrow B in FIG. 3) and includes a cutter 31 which cuts a sheet, a motor 32 which is a driving device, a shuttle 33 which is a movable member, a conveyance guide 34, and the like.

The cutter 31 includes teeth (blades) for cutting the sheet, is attached to the shuttle 33, and guided by the conveyance guide 34 so as to be capable of moving in the direction perpendicular to the sheet conveyance direction (direction of arrow S in FIG. 3=parallel to main scanning direction) by the drive of the motor 32. In FIG. 3, a direction from right to left is a sheet cutting direction of the cutter 31, and an opposite direction from left to right is a returning direction of the cutter 31.

The sheet holder 40 is provided on the downstream side of the cutter device 30 in the sheet conveyance direction and at a sheet cutting start side end (right end in FIG. 3). The sheet holder 40 will be described in detail with reference to FIGS. 5 and 6. A drive from the motor 32 is connected to the sheet holder 40, and the sheet holder 40 holds a holding roller 41 so that the holding roller 41 can move between a sheet holding position and a separated position. At the sheet holding position, the sheet is sandwiched between the holding roller 41 and the lower guide 132, and the sheet is held.

At the time of cutting the sheet, the holding roller 41 of the sheet holder 40 moves to the sheet holding position (position in FIG. 4) so as to secure the vicinity of the cutting start side end of the sheet positioned downstream side of a cutting position. Accordingly, it is possible to prevent drop of the cut sheet due to the weight of the sheet (sheet is obliquely cut since cutting start side falls downward), and oblique cutting can be prevented. After the sheet has been cut, the holding roller 41 moves to the separated position (sheet non-holding position).

Figure 5:
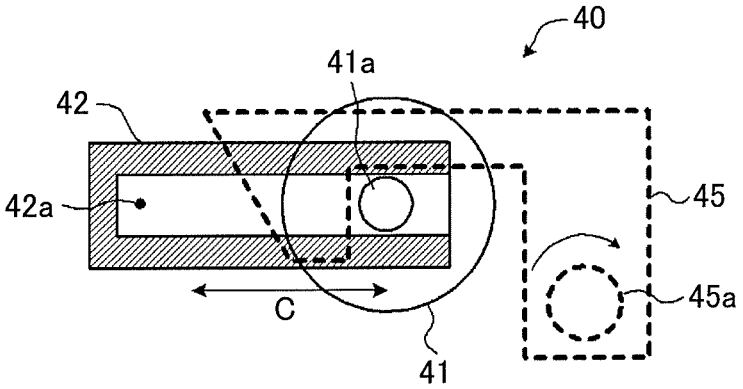
FIG. 5 is a diagram of a specific configuration example of a sheet holding device.
Figure 6:
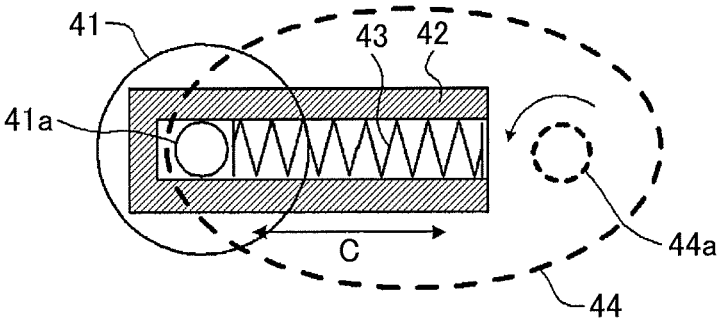
FIG. 6 is a diagram of a specific configuration example of the sheet holding device.

FIGS. 5 and 6 are diagrams of specific configuration examples of sheet holding device.

As illustrated in FIGS. 5 and 6, the sheet holder 40 according to this example includes the holding roller 41, a roller guide 42, a compression spring 43 as a biasing unit, a cam 44, and a lock 45. Incidentally, a case housing these components, a member for transmitting a driving force from the motor 32, and the like, which are not illustrated, are provided, As described above, the holding roller 41 is a holding member for sandwiching the sheet with the lower guide 132 to hold the sheet. Although a roller member is used as the holding member in the sheet holding device in this example, the holding member is not limited to the roller. In the holding roller 41, a roller shaft 41*a* is housed in a guide groove 42*a* of the roller guide 42 and is guided by the roller guide 42 to be movable in a direction of an arrow C. The position of the holding roller 41 in FIG. 6 is the sheet holding position and is the sheet holding state illustrated in FIG. 4.

The compression spring 43 is a biasing unit for biasing the holding roller 41 in a sheet holding direction (direction in which holding roller 41 is pressed against lower guide 132). Although the compression spring is used in this example, other configuration can be used.

The cam 44 has contact with the roller shaft 41*a* of the holding roller 41 and rotates around a cam shaft 44*a* so as to move the holding roller 41 to the sheet holding position and the non-holding position (separated position). The driving force from the motor 32 is transmitted to the cam shaft 44*a*, and a stopper is provided so that the cam 44 does not rotate any more when the holding roller 41 moves to the sheet holding position.

The lock 45 has a claw-like shape and can rotate around a rotation shaft 45*a*. The driving force from the motor 32 is transmitted to the rotation shaft 45*a* to rotate the lock 45. However, a configuration is made to transmit the driving force via a one-way clutch and the like so that the drive is transmitted to the rotation shaft of the lock 45 only in a case where the driving device is driven in a direction in which the cutter 31 moves from the cutting start position to the cutting end position.

In this configuration, when the cutter 31 moves from the cutting start position to the cutting end position, the lock 45 rotates from the illustrated state in a clockwise direction to release the lock (release lock of roller shaft 41*a* of holding roller 41), and the holding roller 41 moves to the left in FIG. 5 and is biased to the sheet holding position illustrated in FIG. 6. When the holding roller 41 moves to the sheet holding position, the cam 44 does not rotate any more as described above so that the holding roller 41 is pressed at the sheet holding position, and the sheet is reliably held and secured.

When the cutting of the sheet is completed and the cutter 31 returns from the cutting end position to the cutting start position, the cam 44 rotates in a reverse direction due to reverse rotation of the motor 32 and moves the holding roller 41 in a direction to be separated from the sheet holding position. In the middle of the movement, when the roller shaft 41*a* has contact with a front inclined surface of the lock 45 to rotate the lock 45 and the holding roller 41 moves to the non-holding position (separated position), a hook portion (jaw portion) of the lock 45 is hooked to the roller shaft 41*a*, and the lock 45 locks the holding roller 41 at the non-holding position (separated position).

As described above, in the present embodiment, the cutting start side end of the sheet on the downstream side of the cutting position can be secured by the sheet holding member. Accordingly, it is possible to prevent the drop of the cut sheet due to the weight of the sheet (sheet is obliquely cut since cutting start side falls downward), and the oblique cutting can be prevented.

Furthermore, the sheet holding member is moved by the driving force of the driving device so that the sheet is automatically held by the sheet holding member. Therefore, it is possible to prevent the oblique cutting occurred because a user forgets the operation.

In addition, by using the driving device for driving the movable member of the cutter as the driving device for moving the sheet holding member, it is not necessary to additionally provide a driving device, and the cost can be suppressed.

By including the cam for moving the sheet holding member to the sheet holding position and the non-holding position, the sheet holding member can be automatically moved with a simple structure.

In addition, by including the lock for locking the sheet holding member at the non-holding position, the sheet holding member does not move to the sheet holding position when it is not required, and conveyance troubles such as paper jam can be prevented.

Furthermore, in the image forming apparatus according to the present embodiment including the sheet cutting device, since the oblique cutting of the roll sheet can be prevented, an output sheet which is cut with high quality can be obtained.

The present disclosure has been described with reference to the illustrated examples. However, embodiments of the present disclosure are not limited to the above-described embodiments. The configuration of the sheet cutting device can be appropriately changed within the scope of the present disclosure, and an appropriate configuration can be employed for the structure and the shape of the sheet holding member and the configuration for moving the sheet holding member.

The image forming apparatus is not limited to the serial type image forming apparatus in the embodiment and may be an image forming apparatus of any system and configuration. Of course, the image forming apparatus is not limited to a large plotter and may be a copying machine, a printer, a facsimile, and a multifunction peripheral including a plurality of functions.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. A sheet cutting device, comprising:

a cutter to cut a sheet conveyed through a conveyance path to a desired length;

a movable member to move the cutter in a cutting direction;

a driving device to drive the movable member; and a sheet holder disposed on a downstream side of a sheet cutting position of the cutter in a sheet conveyance direction, to hold the sheet, the sheet holder including a sheet holding member that is disposed only on a sheet cutting start side end and is movable to a sheet holding position at which the sheet holding member holds the sheet and a non-holding position at which the sheet holding member does not hold the sheet, wherein, when the sheet is cut by the cutter, the sheet holding member moves to the sheet holding position, and after cutting of the sheet has been completed, the sheet holding member moves to the non-holding position.

2. The sheet cutting device according to claim 1, wherein the sheet holding member is moved by a driving force of the driving device.

3. The sheet cutting device according to claim 1, wherein the sheet holder includes a cam to move the sheet holding member to the sheet holding position and the non-holding position.

4. The sheet cutting device according to claim 1, wherein the sheet holder includes a lock to lock the sheet holding member at the non-holding position.

5. The sheet cutting device according to claim 1, wherein the sheet holding member is a roller.

6. An image forming apparatus comprising the sheet cutting device according to claim 1.

7. A sheet cutting device, comprising:

a cutter to cut a sheet conveyed through a conveyance path to a desired length;

a movable member to move the cutter in a direction orthogonal to a sheet conveyance direction;

a driving device to drive the movable member; and a sheet holder disposed on a downstream side of a sheet cutting position of the cutter in a sheet conveyance direction, to hold the sheet, the sheet holder including a sheet holding member that is disposed on a sheet cutting start side end and is movable to a sheet holding position at which the sheet holding member holds the sheet and a non-holding position at which the sheet holding member does not hold the sheet, wherein, when cutting the sheet by moving the cutter relative to the sheet holding member from the sheet cutting start side end in the direction orthogonal to the sheet conveyance direction, the sheet holding member continues to hold the sheet at the sheet holding position on the sheet cutting start side end, and after cutting of the sheet has been completed, the sheet holding member moves to the non-holding position.

8. The sheet cutting device of claim 7, wherein the sheet holding member is moved by a driving force of the driving device.

9. The sheet cutting device of claim 7, wherein the sheet holder includes a cam to move the sheet holding member to the sheet holding position and the non-holding position.

10. The sheet cutting device of claim 7, wherein the sheet holder includes a lock to lock the sheet holding member at the non-holding position.

11. The sheet cutting device of claim 7, wherein the sheet holding member is a roller.

12. An image forming apparatus comprising the sheet cutting device according to claim 7.

* * * * *